US012674238B2

(12) United States Patent
Yoneda et al.

(10) Patent No.: US 12,674,238 B2
(45) Date of Patent: Jul. 7, 2026

(54) ELECTROLYSIS SYSTEM

(71) Applicant: HONDA MOTOR CO., LTD., Tokyo (JP)

(72) Inventors: Hideaki Yoneda, Wako (JP); Masahiro Mohri, Wako (JP); Misato Maki, Wako (JP); Kazuki Yanagisawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 604 days.

(21) Appl. No.: 18/112,669

(22) Filed: Feb. 22, 2023

(65) Prior Publication Data

US 2023/0304164 A1 Sep. 28, 2023

(30) Foreign Application Priority Data

Mar. 24, 2022 (JP) ..... 2022-047670

(51) Int. Cl.

| | |
|---|---|
| ***C25B 1/042*** | (2021.01) |
| ***C25B 1/23*** | (2021.01) |
| ***C25B 3/26*** | (2021.01) |
| ***C25B 9/19*** | (2021.01) |
| ***C25B 15/023*** | (2021.01) |
| ***C25B 15/08*** | (2006.01) |

(52) U.S. Cl.

CPC ..... *C25B 1/042* (2021.01); *C25B 1/23* (2021.01); *C25B 3/26* (2021.01); *C25B 9/19* (2021.01); *C25B 15/023* (2021.01); *C25B 15/081* (2021.01); *C25B 15/083* (2021.01)

(58) Field of Classification Search

USPC ..... 205/350

See application file for complete search history.

(56) References Cited

U.S. PATENT DOCUMENTS

2003/0175565 A1 9/2003 Noda
2005/0089740 A1* 4/2005 Moon ..... H01M 4/9066 429/535

(Continued)

FOREIGN PATENT DOCUMENTS

CN 101901923 A 12/2010
CN 104220645 A 12/2014

(Continued)

OTHER PUBLICATIONS

Tao et al, Carbon Deposition in Solid Oxide Cells during Co-Electrolysis of H2O and CO2, Journal of the Electrochemical Society, vol. 161, No. 3, Jan. 2014, pp. F337-F343 (Year: 2014).*

(Continued)

*Primary Examiner* — Harry D Wilkins, III

(74) *Attorney, Agent, or Firm* — Carrier, Shende & Associates P.C.; Joseph P. Carrier; Jeffrey T. Gedeon

(57) ABSTRACT

An electrolysis system is provided with a valve device that switches between supplying a mixed gas to a cathode and supplying oxygen gas to an anode, an ammeter that measures an electric current between a pair of electrodes, and a control device that controls the valve device to switch what is supplied to the electrolysis device from the mixed gas to the oxygen gas when the electric current falls below a predetermined first threshold value while the mixed gas is supplied to the electrolysis device, and causes carbon deposited on the cathode to react chemically with the oxygen gas.

7 Claims, 8 Drawing Sheets

(56) References Cited

U.S. PATENT DOCUMENTS

| | | | | |
|---|---|---|---|---|
| 2010/0304249 | A1 | 12/2010 | Tsuchiya et al. | |
| 2015/0038741 | A1 | 2/2015 | Pedersen et al. | |
| 2018/0023202 | A1* | 1/2018 | Krause | C25B 15/08 205/440 |
| 2018/0145351 | A1 | 5/2018 | Wang et al. | |
| 2018/0274109 | A1* | 9/2018 | Kudo | C25B 1/04 |
| 2020/0179897 | A1* | 6/2020 | Rueger | C25B 1/00 |

FOREIGN PATENT DOCUMENTS

| | | | | | |
|---|---|---|---|---|---|
| CN | 108091907 | A | | 5/2018 | |
| CN | 108624905 | A | | 10/2018 | |
| JP | 2017-043506 | A | | 3/2017 | |
| JP | 2018154901 | A | * | 10/2018 | C25B 15/02 |
| JP | 2022-022978 | A | | 2/2022 | |

OTHER PUBLICATIONS

Office Action and Search Report dated May 14, 2026 issued in the corresponding Chinese Patent Application No. 202310171275.0 with the English machine translation thereof.

Youkun et al., "Carbon Deposition in Solid Oxide Cells during Co-Electrolysis of H20 and CO2", Journal of the Electrochemical Society, 161(3) F337-F343, Jan. 9, 2014.

* cited by examiner

ELECTROLYSIS SYSTEM

CROSS-REFERENCE TO RELATED APPLICATIONS

This application is based upon and claims the benefit of priority from Japanese Patent Application No. 2022-047670 filed on Mar. 24, 2022, the contents of which are incorporated herein by reference.

BACKGROUND OF THE INVENTION

Field of the Invention

The present invention relates to an electrolysis system.

Description of the Related Art

In recent years, efforts to realize a low-carbon or decarbonized society have become active, and research and development on electrolysis systems contributing to energy efficiency are being carried out.

JP 2022-022978 A discloses a method for co-producing methanol and methane. The method includes an electrolysis step and a methanol synthesis step. In the electrolysis process, a mixed gas of water vapor and carbon dioxide is reduced in a solid oxide electrolysis cell to produce a synthesis gas containing hydrogen, carbon monoxide, carbon dioxide and water vapor. In the methanol synthesis process, methanol is synthesized from the synthesis gas via a methanol synthesis catalyst.

SUMMARY OF THE INVENTION

However, in JP 2022-022978 A, carbon tends to be deposited on the fuel electrode (cathode) as the utilization rate of the raw material gas in the solid oxide electrolytic cell increases. Once carbon has been deposited, the electrolysis efficiency of the mixed gas is reduced.

An object of the present invention is to solve the aforementioned problems.

Disclosed is an electrolysis system including an electrolysis device that includes an electrolyte membrane and a pair of electrodes that are a cathode and an anode sandwiching the electrolyte membrane and electrolyzes a mixed gas containing carbon dioxide gas and water vapor, a hydrocarbon generating device that generates a hydrocarbon based on a hydrogen-containing gas generated through the electrolysis, a valve device that switches between supply of the mixed gas to the cathode and supply of oxygen gas to the anode, an ammeter that measures a current between the pair of electrodes, and a control device that controls the valve device to switch that is supplied to the electrolysis device from the mixed gas to the oxygen gas when the current falls below a predetermined first threshold value while the mixed gas is supplied to the electrolysis device, and causes carbon deposited on the cathode to react chemically with the oxygen gas.

According to the above-described aspect, carbon deposition on the cathode can be reduced. As a result, reduction in the electrolysis efficiency of the mixed gas can be suppressed. Thus, the present invention contributes to the improvement in energy efficiency.

The above and other objects, features, and advantages of the present invention will become more apparent from the following description when taken in conjunction with the accompanying drawings, in which a preferred embodiment of the present invention is shown by way of illustrative example.

DETAILED DESCRIPTION OF THE INVENTION

First Embodiment

Figure 1:
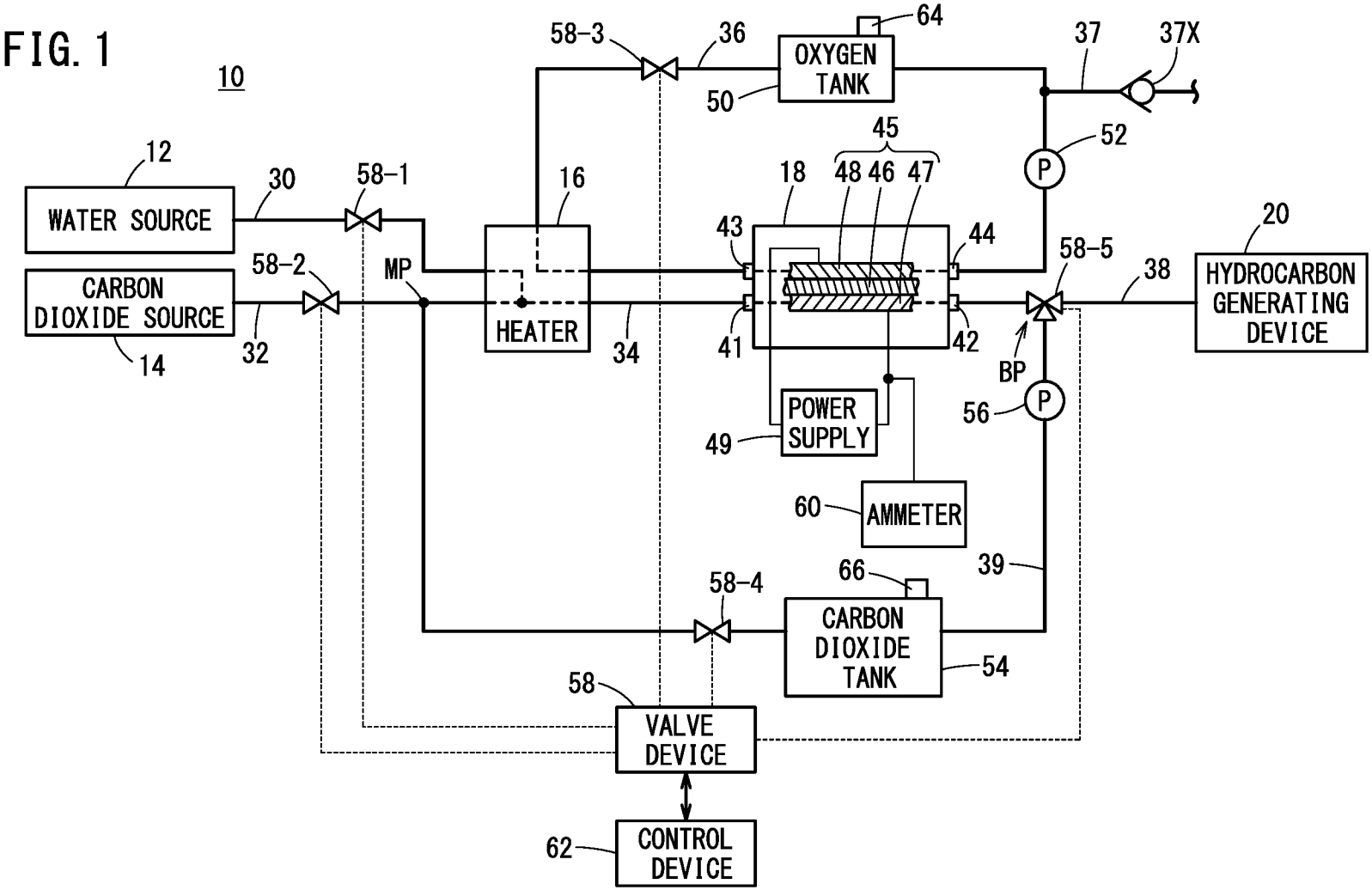
FIG. 1 is a schematic diagram showing the configuration of an electrolysis system according to the first embodiment.

FIG. 1 is a schematic diagram showing a configuration of an electrolysis system 10 according to a first embodiment. The electrolysis system 10 includes a water source 12, a carbon dioxide source 14, a heater 16, an electrolysis device 18, and a hydrocarbon generating device 20.

The water source 12 outputs water, which is a water vapor source supplied to the electrolysis device 18. The water source 12 may be a water supply device or a water tank. The water source 12 may be a water extracting device for extracting water of a predetermined purity from waste liquid of a plant facility.

The carbon dioxide source 14 outputs carbon dioxide gas supplied to the electrolysis device 18. The carbon dioxide source 14 may be a carbon dioxide gas separation device for separating carbon dioxide gas from the atmosphere. The carbon dioxide source 14 may be a carbon dioxide gas extracting device for extracting carbon dioxide gas of a predetermined purity from exhaust gas of a plant facility. The carbon dioxide gas extraction device may be provided to the same plant facility as the one with the water extraction device described above, or may be provided to a plant facility different from the one with the water extraction device.

A heater 16 heats fluid flowing in each of a water flow path 30, a carbon dioxide gas flow path 32, and a mixed gas flow path 34. Part of each of the water flow path 30, the carbon dioxide gas flow path 32, and the mixed gas flow path 34 is disposed inside the heater 16.

The water flow path 30 connects the water source 12 and the mixed gas flow path 34. The water flowing into the water flow path 30 from the water source 12 is heated by the heater 16, and the water vapor vaporized by the heating flows into the mixed gas flow path 34.

The carbon dioxide gas flow path 32 connects the carbon dioxide source 14 and the mixed gas flow path 34. The carbon dioxide gas flowing from the carbon dioxide source 14 into the carbon dioxide gas flow path 32 is heated by the heater 16 and flows into the mixed gas flow path 34.

The mixed gas flow path 34 connects the flow paths of the water flow path 30 and the carbon dioxide gas flow path 32 with a cathode inlet 41 of the electrolysis device 18. The mixed gas containing carbon dioxide gas and water vapor flowing into the mixed gas flow path 34 is heated by the heater 16 and flows into the electrolysis device 18 from the cathode inlet 41.

The electrolysis device 18 is a device for electrolyzing carbon dioxide gas and water vapor. The electrolysis device 18 includes the cathode inlet 41, a cathode outlet 42, an anode inlet 43, an anode outlet 44, and a plurality of unit cells 45.

Each unit cell 45 is provided with a membrane electrode assembly (MEA) in which an electrolyte membrane 46 is sandwiched between a cathode 47 and an anode 48. The electrolyte membrane 46 is a solid oxide type electrolyte membrane. The cathode 47 may be referred to as a fuel electrode. The anode 48 may be referred to as an oxygen electrode. A power supply 49 is connected to the cathode 47 and the anode 48.

The electrolysis device 18 applies voltage supplied from the power supply 49 to the cathode 47 and the anode 48 of each unit cell 45. The electrolysis device 18 supplies the mixed gas flowing in from the cathode inlet 41 to the cathode 47 of each unit cell 45.

When the mixed gas is supplied to the cathode 47 in a state in which voltage is applied to the cathode 47 and the anode 48, each unit cell 45 starts electrolysis of carbon dioxide gas and water vapor contained in the mixed gas. When the electrolysis of carbon dioxide gas and water vapor starts, carbon monoxide gas and hydrogen gas are generated at the cathode 47, and oxygen gas is generated at the anode 48.

The electrolysis device 18 collects the oxygen gas generated in each unit cell 45 and outputs the oxygen gas from the anode outlet 44 to an oxygen gas flow path 36. The electrolysis device 18 collects the carbon monoxide gas and the hydrogen gas produced in each unit cell 45, and outputs a hydrogen-containing gas containing the carbon monoxide gas and hydrogen gas from the cathode outlet 42 to a hydrogen-containing gas flow path 38. The hydrogen-containing gas contains non-electrolyzed water vapor and carbon dioxide in addition to the carbon monoxide gas and the hydrogen gas produced in each unit cell 45. The hydrogen-containing gas flowing into the hydrogen-containing gas flow path 38 flows into the hydrocarbon generating device 20 via a heat exchanger, a dehumidifier, or the like.

The hydrocarbon generating device 20 generates, through a catalytic reaction, hydrocarbons from the carbon monoxide gas and the hydrogen gas contained in the hydrogen-containing gas generated by the electrolysis device 18. The hydrocarbon generating device 20 may generate hydrocarbons using a Fischer-Tropsch process.

The electrolysis system 10 according to the present embodiment further includes an oxygen tank 50, a first pump 52, a carbon dioxide tank 54, a second pump 56, a valve device 58, an ammeter 60, and a control device 62.

The oxygen tank 50 stores oxygen gas. The oxygen gas stored in the oxygen tank 50 is generated at the anode 48 by electrolysis of the electrolysis device 18. The gas pressure in the oxygen tank 50 is measured by a gas pressure sensor 64. The gas pressure sensor 64 is provided to the oxygen tank 50.

The oxygen tank 50 is installed on the oxygen gas flow path 36. The oxygen gas flow path 36 connects the anode outlet 44 of the electrolysis device 18 and the anode inlet 43 of the electrolysis device 18. Part of the oxygen gas flow path 36 between the oxygen tank 50 and the anode inlet 43 of the electrolysis device 18 is arranged in the heater 16. The oxygen gas flowing into the oxygen gas flow path 36 from the oxygen tank 50 is heated by the heater 16 and flows into the electrolysis device 18 from the anode inlet 43 of the electrolysis device 18.

The first pump 52 is installed on the oxygen gas flow path 36 between the oxygen tank 50 and the anode outlet 44 of the electrolysis device 18. The first pump 52 supplies the oxygen tank 50 with the oxygen gas flowing into the oxygen gas flow path 36 from the anode outlet 44 of the electrolysis device 18. When the gas pressure in the oxygen tank 50 exceeds a predetermined upper limit value, the gas pressure of the oxygen gas in the oxygen gas flow path 36 increases. When the gas pressure of the oxygen gas in the oxygen gas flow path 36 exceeds a predetermined gas pressure threshold value, a check valve 37X provided in a purge flow path 37 is opened to discharge oxygen-containing gas from the oxygen gas flow path 36. In the present embodiment, the purge flow path 37 is connected to the oxygen gas flow path 36 between the oxygen tank 50 and the anode outlet 44.

The carbon dioxide tank 54 stores carbon dioxide-containing gas. The carbon dioxide-containing gas stored in the carbon dioxide tank 54 contains carbon dioxide gas and oxygen gas. The carbon dioxide gas is generated through a chemical reaction between carbon deposited on the cathode 47 and oxygen ions that have passed through the electrolyte membrane 46. The gas pressure in the carbon dioxide tank 54 is measured by a gas pressure sensor 66. The gas pressure sensor 66 is provided to the carbon dioxide tank 54.

The carbon dioxide tank 54 is installed on the second carbon dioxide gas flow path 39. The second carbon dioxide gas flow path 39 branches from the hydrogen-containing gas flow path 38 and joins the carbon dioxide gas flow path 32 between the carbon dioxide source 14 and the heater 16. The carbon dioxide-containing gas flowing into the second carbon dioxide gas flow path 39 from the carbon dioxide tank 54 is heated by the heater 16 and flows into the electrolysis device 18 from the anode inlet 43 of the electrolysis device 18.

The second pump 56 is installed on the second carbon dioxide gas flow path 39 between the carbon dioxide tank 54 and the hydrogen containing gas flow path 38. The second pump 56 delivers the carbon dioxide-containing gas flowing into the hydrogen-containing gas flow path 38 from the cathode outlet 42 of the electrolysis device 18 to the second carbon dioxide gas flow path 39.

The valve device 58 is configured to be able to switch between supplying the mixed gas to the cathode 47 of the electrolysis device 18 and supplying the oxygen gas to the anode 48 of the electrolysis device 18. The valve device 58 includes a first on-off valve 58-1, a second on-off valve 58-2, a third on-off valve 58-3, a fourth on-off valve 58-4, and a three way valve 58-5.

The first on-off valve 58-1 is installed on the water flow path 30. The second on-off valve 58-2 is installed on the carbon dioxide gas flow path 32. The third on-off valve 58-3 is installed on the oxygen gas flow path 36 between the oxygen tank 50 and the heater 16. The fourth on-off valve 58-4 is installed on the second carbon dioxide gas flow path 39 between the carbon dioxide tank 54 and a merging portion MP. The merging portion MP is a portion where the second carbon dioxide gas flow path 39 merges with the carbon dioxide gas flow path 32. The three way valve 58-5 is installed at a branch portion BP. The branch portion BP is a portion where the second carbon dioxide gas flow path 39 branches from the hydrogen containing gas flow path 38.

The ammeter 60 is connected to a closed circuit formed by a cathode 47, an anode 48 and a power supply 49. The ammeter 60 measures electric current between the cathode 47 and the anode 48. The measured current may be current between the cathode 47 and the anode 48 of the plurality of unit cells 45 or current between the cathode 47 and the anode 48 of one unit cell 45. However, it is preferable that the measured current is current between the cathode 47 and the anode 48 of the plurality of unit cells 45.

The control device 62 controls the heater 16 to turn on the heater 16 when receiving an instruction to activate the electrolysis system 10. Thereafter, the control device 62 causes the electrolysis device 18 to execute either one of the electrolysis mode or the consumption mode based on the current measured by the ammeter 60. The electrolysis mode is a mode in which the mixed gas is electrolyzed. The consumption mode is a mode in which carbon deposited on the cathode 47 is consumed.

Figure 2:
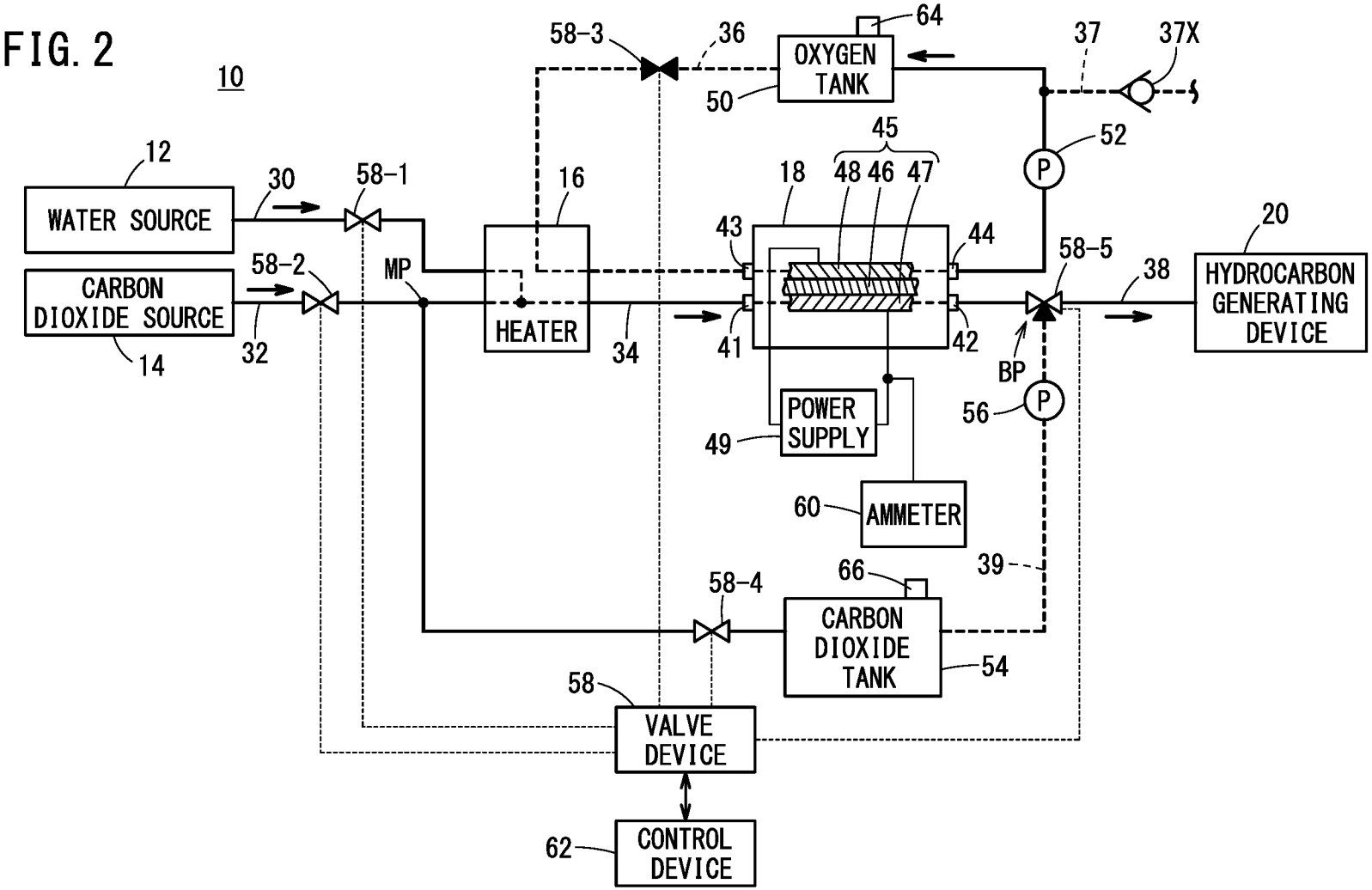
FIG. 2 is a diagram showing the flow of fluid when an electrolysis mode is executed.

FIG. 2 is a diagram showing the flow of fluid when an electrolysis mode is executed. The control device 62 controls the power supply 49, the valve device 58, and the first pump 52 when the electrolysis device 18 executes the electrolysis mode. In this case, the control device 62 turns on the first pump 52 and applies voltage to the cathode 47 and the anode 48. Further, the control device 62 opens the first on-off valve 58-1, the second on-off valve 58-2, and the fourth on-off valve 58-4 and closes the third on-off valve 58-3. In addition, the control device 62 controls the three way valve 58-5 to open the hydrogen containing gas flow path 38 and close the second carbon dioxide gas flow path 39.

The control device 62 may open both of the second on-off valve 58-2 and the fourth on-off valve 58-4 simultaneously. Alternatively, the control device 62 may open the second on-off valve 58-2 after opening the fourth on-off valve 58-4. In this case, when the gas pressure in the carbon dioxide tank 54 measured by the gas pressure sensor 66 falls below a predetermined lower limit value, the control device 62 opens the second on-off valve 58-2 to start the supply of carbon dioxide gas from the carbon dioxide source 14.

When the electrolysis mode is executed, the water vapor acquired from water output from the water source 12 and the carbon dioxide gas output from the carbon dioxide source 14 or the carbon dioxide tank 54 flow into the electrolysis device 18 from the cathode inlet 41. The water vapor and the carbon dioxide gas flowing into the electrolysis device 18 are electrolyzed based on the voltage applied to the cathode 47 and the anode 48.

The carbon monoxide gas and the hydrogen gas produced through electrolysis at the cathode 47 are supplied, as hydrogen-containing gas, from the cathode outlet 42 of the electrolysis device 18 to the hydrocarbon generating device 20 through the hydrogen-containing gas flow path 38. The oxygen gas generated at the anode 48 through electrolysis is output from the anode outlet 44 of the electrolysis device 18 to the oxygen gas flow path 36. The oxygen gas output to the oxygen gas flow path 36 is supplied to the oxygen tank 50 by the first pump 52 and stored in the oxygen tank 50.

The control device 62 causes the oxygen gas to be stored in the oxygen tank 50 until the gas pressure in the oxygen tank 50 measured by the gas pressure sensor 64 reaches a predetermined upper limit value. When the gas pressure exceeds the upper limit value, the control device 62 turns off the first pump 52.

Further, the control device 62 monitors current (electrolytic current) measured by the ammeter 60 during execution of the electrolysis mode. Once carbon has been deposited on the cathode 47, the carbon functions as a resistor and the electrolytic current is reduced. Therefore, as the amount of deposited carbon increases, the amount of reduction of electrolytic current increases. When the electrolytic current is less than a predetermined first threshold value, the control device 62 judges that carbon exceeding a predetermined amount has been deposited on the cathode 47. In this case, the control device 62 stops the application of the voltage to the cathode 47 and the anode 48 and causes the electrolysis device 18 to execute the consumption mode.

When the current (electrolytic current) falls below the first threshold value before the gas pressure in the oxygen tank 50 reaches the upper limit value, the control device 62 stops the application of voltage and turns off the first pump 52.

Figure 3:
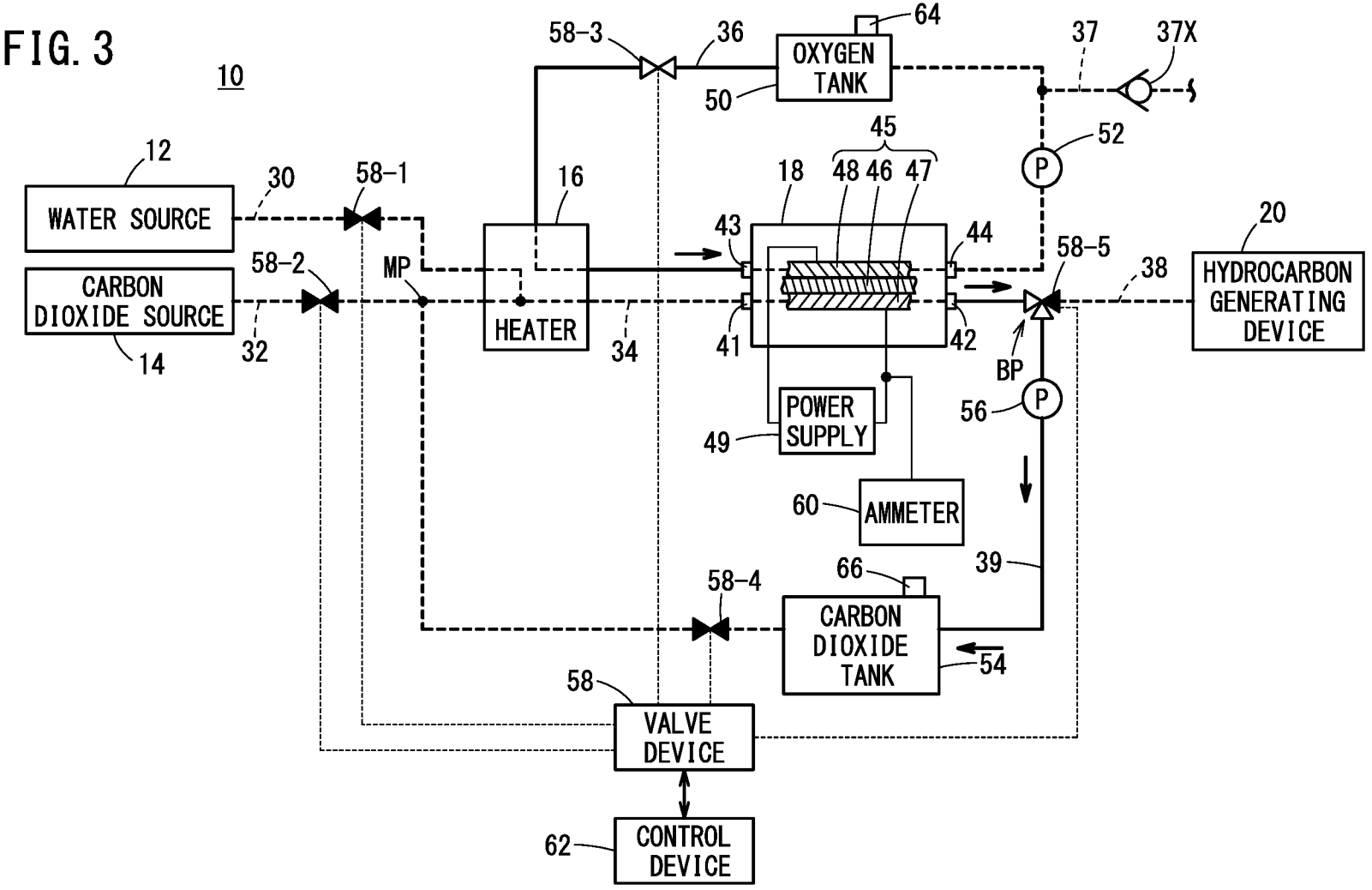
FIG. 3 is a diagram showing the flow of fluid when a consumption mode is executed.

FIG. 3 is a diagram showing the flow of fluid when a consumption mode is executed. The control device 62 controls the second pump 56 and the valve device 58 when the electrolysis device 18 executes the consumption mode. In this case, the control device 62 turns on the second pump 56. Further, the control device 62 opens the third on-off valve 58-3 and closes the first on-off valve 58-1, the second on-off valve 58-2, and the fourth on-off valve 58-4, thereby switching what is supplied to the electrolysis device 18 from the mixed gas to the oxygen gas. In addition, the control device 62 controls the three way valve 58-5 to close the hydrogen-containing gas flow path 38 and open the second carbon dioxide gas flow path 39.

When the consumption mode is executed, the oxygen gas output from the oxygen tank 50 flows into the electrolysis device 18 from the anode inlet 43. The oxygen gas flowing into the electrolysis device 18 is supplied to the anode 48, and the oxygen ions generated from the oxygen gas passes through the electrolyte membrane 46.

The oxygen ions that have passed through the electrolyte membrane 46 chemically react with carbon deposited on the cathode 47. The carbon dioxide gas generated through the chemical reaction flows out from the cathode outlet 42 of the electrolysis device 18 to the second carbon dioxide gas flow path 39 as carbon dioxide-containing gas containing excess oxygen gas that has not chemically reacted with carbon. The carbon dioxide-containing gas flowing into the second carbon dioxide gas flow path 39 is supplied to the carbon dioxide tank 54 by the second pump 56 and is stored in the carbon dioxide tank 54.

The control device 62 causes the carbon dioxide-containing gas to be stored in the carbon dioxide tank 54 until the gas pressure in the carbon dioxide tank 54 measured by the gas pressure sensor 66 reaches a predetermined upper limit value. When the gas pressure exceeds the upper limit value, the control device 62 turns off the second pump 56.

Further, the control device 62 monitors a current (power-generation current) measured by the ammeter 60 during execution of the consumption mode. As the amount of carbon chemically reacting with the oxygen gas supplied to the cathode 47 decreases, the amount of decrease in the power-generation current obtained by the chemical reaction increases. When the power-generation current is less than a predetermined second threshold value, the control device 62 judges that the amount of carbon deposited on the cathode 47 is an acceptable amount. In this case, the control device 62 causes the electrolysis device 18 to execute the electrolysis mode. By this execution, what is supplied to the electrolysis device 18 is switched from the mixed gas to the oxygen gas.

When the current (power-generation current) becomes lower than the second threshold value before the gas pressure in the carbon dioxide tank 54 reaches the upper limit value, the control device 62 turns off the second pump 56 and causes the electrolysis device 18 to execute the electrolysis mode. The power-generation current obtained during the execution of the consumption mode may be stored in a storage battery or supplied as a driving current to an electronic device in the electrolysis system 10. As a result, energy of the electrolysis system 10 can be compensated, which leads to an improvement in efficiency.

Figure 4:
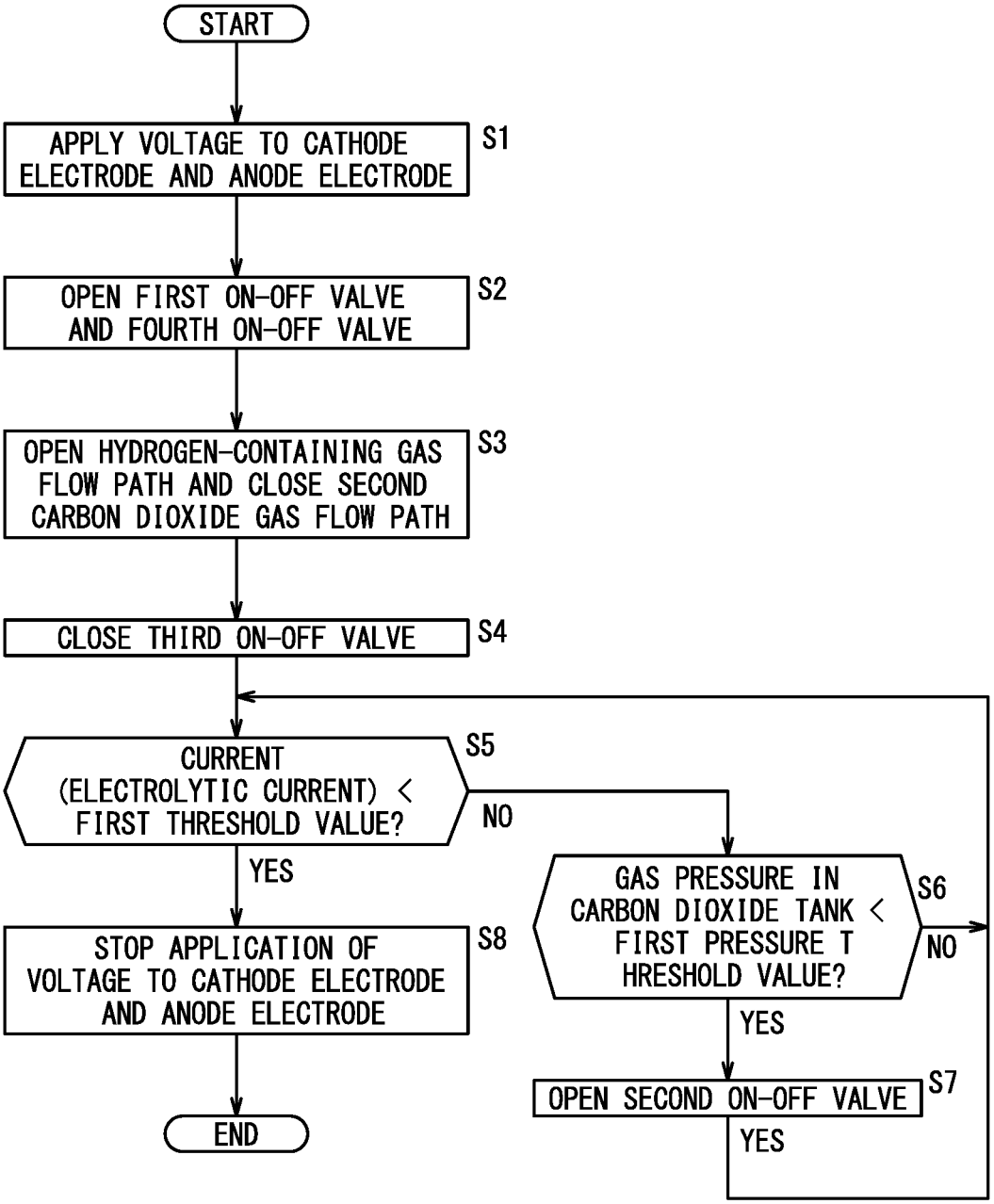
FIG. 4 is a flowchart showing the procedure of an electrolysis control process.

FIG. 4 is a flowchart showing the procedure of an electrolysis control process. The electrolysis control process is a process for causing the electrolysis device 18 to execute the electrolysis mode. In FIG. 4, control of the first pump 52 is omitted. FIG. 4 shows an example in which the second on-off valve 58-2 opens after the fourth on-off valve 58-4 opens.

In step S1, the control device 62 applies voltage to the cathode 47 and the anode 48. Thereafter, the electrolytic control process proceeds to step S2.

In step S2, the control device 62 opens the first on-off valve 58-1 and the fourth on-off valve 58-4 and supplies carbon dioxide gas and water vapor to the device 18. When the first on-off valve 58-1 and the fourth on-off valve 58-4 are opened, the electrolysis control process proceeds to step S3.

In step S3, the control device 62 controls the three way valve 58-5 to open the hydrogen-containing gas flow path 38 and close the second carbon dioxide gas flow path 39. When the hydrogen-containing gas flow path 38 is opened, the electrolysis control process proceeds to step S4.

In step S4, the control device 62 closes the third on-off valve 58-3 and starts storing the oxygen gas generated by the electrolysis device 18 in the oxygen tank 50. When the third on-off valve 58-3 is closed, the electrolysis control process proceeds to step S5.

In step S5, the control device 62 compares the current (electrolytic current) measured by the ammeter 60 with a predetermined first threshold value. When the current is equal to or greater than the first threshold value (step S5: NO), the electrolysis control process proceeds to step S6. On the other hand, when the current is less than the first threshold value (step S5: YES), the electrolytic control process proceeds to step S8.

In step S6, the control device 62 compares the gas pressure in the carbon dioxide tank 54 measured by the gas pressure sensor 66 with a first pressure threshold value. When the gas pressure is equal to or higher than the first pressure threshold (step S6: NO), the electrolysis control process returns to step S5. On the contrary, when the gas pressure is lower than the first pressure threshold value (step S6: YES), the electrolytic control process proceeds to step S7.

In step S7, the control device 62 opens the second on-off valve 58-2 and starts the supply of carbon dioxide gas from the carbon dioxide source 14 to the electrolysis device 18. When the second on-off valve 58-2 is opened, the electrolysis control process returns to step S5. When the second on-off valve 58-2 is opened, the control device 62 stops the comparison with the first pressure threshold value in step S6. In this case, the electrolysis control process remains at step S5 until the current falls below the first threshold value.

In step S8, the control device 62 stops the application of voltage to the cathode 47 and the anode 48. Thereafter, the electrolytic control process is terminated.

Figure 5:
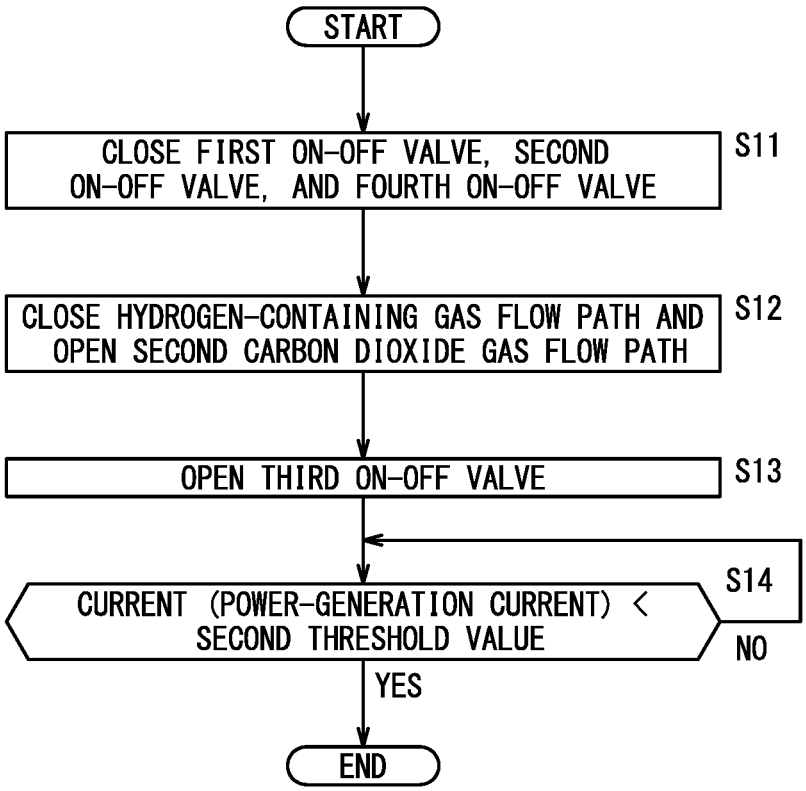
FIG. 5 is a flowchart showing the procedure of a consumption control process.

FIG. 5 is a flowchart showing the procedure of a consumption control process. The consumption control process is a process for causing the electrolysis device 18 to execute the consumption mode. In FIG. 5, the control of the second pump 56 is omitted.

In step S11, the control device 62 closes the first on-off valve 58-1, the second on-off valve 58-2, and the fourth on-off valve 58-4 and stops the supply of carbon dioxide gas and water vapor to the electrolysis device 18. When the second on-off valve 58-2 is not opened in the electrolysis mode, the control device 62 closes only the first on-off valve 58-1 and the fourth on-off valve 58-4. When the valve closing is completed, the consumption control process proceeds to step S12.

In step S12, the control device 62 controls the three way valve 58-5 to close the hydrogen-containing gas flow path 38 and open the second carbon dioxide gas flow path 39. When the second carbon dioxide gas flow path 39 is opened, the consumption control process proceeds to step S13.

In step S13, the control device 62 opens the third on-off valve 58-3 to start the supply of oxygen gas to the electrolysis device 18. When the third on-off valve 58-3 is opened, the consumption control process proceeds to step S14.

In step S14, the control device 62 compares the current measured by the ammeter 60 with a second predetermined threshold value. If the current is greater than or equal to the second threshold (step S14: NO), the electrolysis mode remains in step S14. If the current is less than the second threshold value (step S14: YES), the consumption control process is terminated.

As described above, in the first embodiment, when the current generated between the cathode 47 and the anode 48 through electrolysis of the electrolysis device 18 falls below the predetermined first threshold value, the control device 62 causes the electrolysis device 18 to execute the consumption mode. In this case, the control device 62 switches which gas is supplied to the electrolysis device 18 from the mixed gas to the oxygen gas so that the carbon deposited on the cathode 47 chemically reacts with the oxygen gas. As a result, carbon deposited on the cathode 47 can be reduced. As a result, reduction in the electrolysis efficiency for the mixed gas can be suppressed.

Second Embodiment

Figure 6:
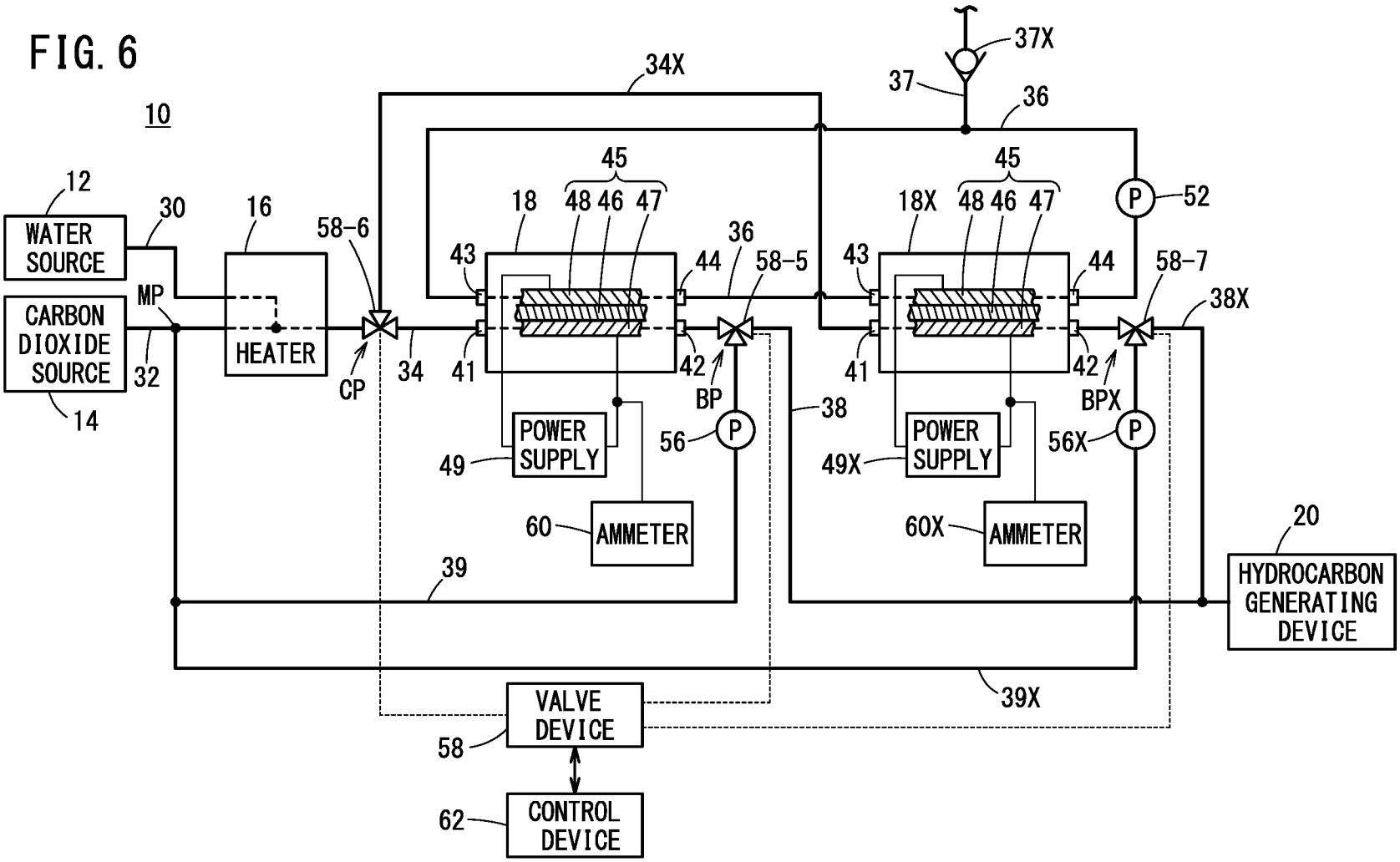
FIG. 6 is a schematic diagram showing the configuration of an electrolysis system according to the second embodiment.

FIG. 6 is a schematic diagram showing the configuration of the electrolysis system 10 according to the second embodiment. In FIG. 6, the same components as those described in the first embodiment are denoted by the same reference numerals. In the present embodiment, descriptions that overlap with those of the first embodiment are omitted.

The electrolysis system 10 according to the present embodiment is newly provided with a second electrolysis device 18X, a second mixed gas flow path 34X, a second hydrogen-containing gas flow path 38X, a third carbon dioxide gas flow path 39X, and a third pump 56X.

The second electrolysis device 18X is an electrolysis device different from the electrolysis device 18 of the first embodiment. The configuration of the second electrolysis device 18X is the same as that of the electrolysis device 18 of the first embodiment. That is, the second electrolysis device 18X has the cathode inlet 41, the cathode outlet 42, the anode inlet 43, the anode outlet 44, and the plurality of unit cells 45. A power supply 49X is connected to the cathode 47 and the anode 48 of the unit cell 45, and an ammeter 60X is connected to a circuit formed by the power supply 49, the cathode 47 and the anode 48.

Similarly to the electrolysis device 18, the second electrolysis device 18X electrolyzes the carbon dioxide gas and water vapor flowing in from the cathode inlet 41. The second electrolysis device 18X outputs, as hydrogen-containing gas, the carbon monoxide gas and the hydrogen gas generated through electrolysis at the cathode 47 from the cathode outlet 42. The second electrolysis device 18X outputs from the anode outlet 44 the oxygen gas generated through electrolysis at the anode 48.

Similarly to the electrolysis device 18, the second electrolysis device 18X consumes carbon deposited on the cathode 47 through chemical reactions with the oxygen gas supplied from the anode inlet 43. The second electrolysis device 18X outputs from the cathode outlet 42, as carbon dioxide-containing gas, carbon dioxide gas generated through chemical reactions between the carbon deposited on the cathode 47 and the oxygen ions passing through the electrolyte membrane 46.

The second mixed gas flow path 34X connects the cathode inlet 41 of the second electrolysis device 18X and the mixed gas flow path 34. The mixed gas flowing into the second mixed gas flow path 34X from the mixed gas flow path 34 flows into the electrolysis device 18 from the cathode inlet 41 of the second electrolysis device 18X. A second three way valve 58-6 is installed at a connecting portion CP between the second mixed gas flow path 34X and the mixed gas flow path 34.

The second hydrogen-containing gas flow path 38X connects the cathode outlet 42 of the second electrolysis device 18X and the hydrogen-containing gas flow path 38. The hydrogen-containing gas flowing from the cathode outlet 42 into the second hydrogen-containing gas flow path 38X is supplied to the hydrocarbon generating device 20.

The third carbon dioxide gas flow path 39X separates from the second hydrogen-containing gas flow path 38X and merges with the second carbon dioxide gas flow path 39. A third three way valve 58-7 is installed at a branch portion BPX where the third carbon dioxide gas flow path 39X branches from the second hydrogen-containing gas flow path 38X. The carbon dioxide tank 54 is not installed on the second carbon dioxide gas flow path 39 of the present embodiment.

The third pump 56X is installed on the third carbon dioxide gas flow path 39X. The third pump 56X delivers the carbon dioxide-containing gas flowing into the second hydrogen-containing gas flow path 38X from the cathode outlet 42 of the second electrolysis device 18X to the third carbon dioxide gas flow path 39X.

In the electrolysis system 10 according to the present embodiment, the oxygen gas flow path 36 connects the anode outlet 44 of the second electrolysis device 18X and the anode inlet 43 of the electrolysis device 18. In addition, the oxygen gas flow path 36 connects the anode outlet 44 of the electrolysis device 18 and the anode inlet 43 of the second electrolysis device 18X. Therefore, the oxygen gas circulates between the anode 48 of the electrolysis device 18 and the anode 48 of the second electrolysis device 18X via the oxygen gas flow path 36. The oxygen tank 50 is not provided on the oxygen gas flow path 36 of the present embodiment. On the other hand, the purge flow path 37 is connected to the oxygen gas flow path 36 as in the first embodiment, and a check valve 37X is provided on the purge flow path 37.

In the electrolysis system 10 according to the present embodiment, the first on-off valve 58-1, the second on-off valve 58-2, the third on-off valve 58-3, and the fourth on-off valve 58-4 are not present. That is, the valve device 58 does not include the first on-off valve 58-1, the second on-off valve 58-2, the third on-off valve 58-3, and the fourth on-off valve 58-4. The valve device 58 of the present embodiment includes the three way valve 58-5, the second three way valve 58-6, and the third three way valve 58-7.

The control device 62 causes the electrolysis device 18 to execute either one of the electrolysis mode or the consumption mode and causes the second electrolysis device 18X to execute the other of the electrolysis mode and the consumption mode. An index value for switching between the electrolysis mode and the consumption mode may be the current measured by the ammeter 60 of the electrolysis device 18 or the current measured by the ammeter 60X of the second electrolysis device 18X.

That is, when the current (electrolytic current) measured by the ammeter 60 of the electrolysis device 18 (or the second electrolysis device 18X) falls below a predetermined first threshold value, the control device 62 causes the electrolysis device 18 to execute the consumption mode. In this case, the control device 62 causes the second electrolysis device 18X to execute the electrolysis mode.

On the other hand, when the current (power-generation current) measured by the ammeter 60 of the electrolysis device 18 (or the second electrolysis device 18X) falls below the predetermined second threshold value, the control device 62 causes the electrolysis device 18 to execute the electrolysis mode. In this case, the control device 62 causes the second electrolysis device 18X to execute the consumption mode.

It should be noted that the index values for switching between the electrolysis mode and the consumption mode may be the ammeters 60 of both the electrolysis device 18 and the second electrolysis device 18X.

Figure 7:
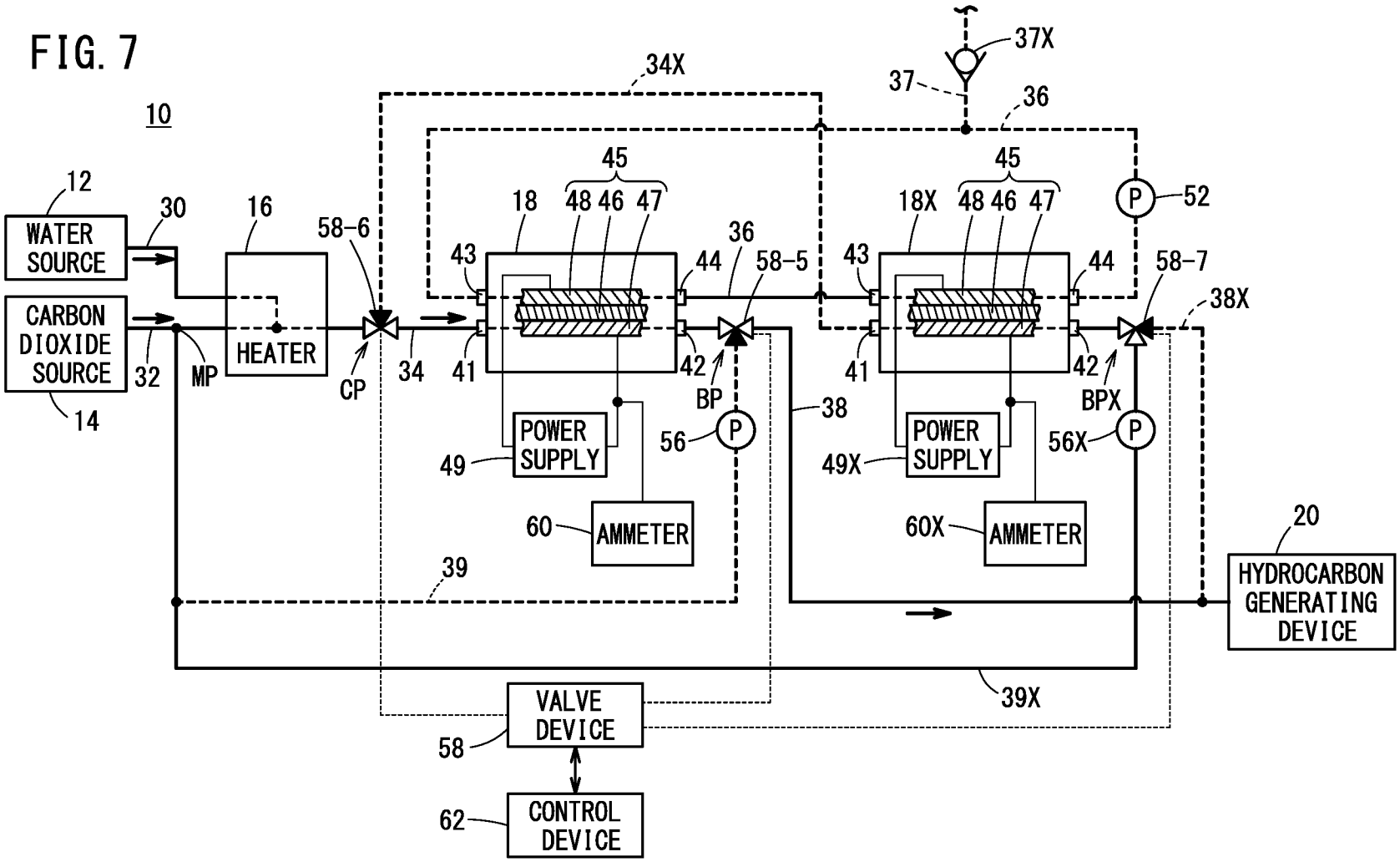
FIG. 7 is a diagram showing the flow of fluid when the electrolysis mode is executed for an electrolysis device and the consumption mode is executed for the second electrolysis device.

FIG. 7 is a diagram showing the flow of fluid when the electrolysis mode is executed for the electrolysis device 18 and the consumption mode is executed for the second electrolysis device 18X. The control device 62 controls the power supply 49, the valve device 58, and the third pump 56X when the electrolysis device 18 is caused to execute the electrolysis mode and the second electrolysis device 18X is caused to execute the consumption mode.

In this case, the control device 62 turns on the third pump 56X and applies a voltage to the cathode 47 and the anode 48 of the electrolysis device 18. The control device 62 also controls the three way valve 58-5 to open the hydrogen-containing gas flow path 38 and close the second carbon dioxide gas flow path 39. Further, the control device 62 controls the second three way valve 58-6 to open the mixed gas flow path 34 and close the second mixed gas flow path 34X. The control device 62 controls the third three way valve 58-7 to open the third carbon dioxide gas flow path 39X and close the second hydrogen-containing gas flow path 38X.

When the electrolysis mode is executed for the electrolysis device 18 and the consumption mode is executed for the second electrolysis device 18X, water vapor obtained from water output from the water source 12 and carbon dioxide gas output from the carbon dioxide source 14 flow into the electrolysis device 18 from the cathode inlet 41. The water vapor and the carbon dioxide gas flowing into the electrolysis device 18 are electrolyzed based on the voltage applied to the cathode 47 and the anode 48.

The carbon monoxide gas and the hydrogen gas produced through electrolysis at the cathode 47 are supplied, as hydrogen-containing gas, from the cathode outlet 42 of the electrolysis device 18 to the hydrocarbon generating device 20 through the hydrogen-containing gas flow path 38.

On the other hand, the oxygen gas generated at the anode 48 through electrolysis flows from the anode outlet 44 of the electrolysis device 18 to the anode inlet 43 of the second electrolysis device 18X via the oxygen gas flow path 36. The oxygen gas flowing into the second electrolysis device 18X from the anode inlet 43 is supplied to the anode 48, passes through the electrolyte membrane 46, and is supplied to the cathode 47.

The oxygen gas supplied to the cathode 47 of the second electrolysis device 18X chemically reacts with carbon deposited on the cathode 47. The carbon dioxide gas produced by this chemical reaction flows out from the cathode outlet 42 of the second electrolysis device 18X to the second hydrogen-containing gas flow path 38X as a carbon dioxide-containing gas containing excess oxygen gas that has not chemically reacted with carbon. The carbon dioxide-containing gas flowing into the second hydrogen-containing gas flow path 38X is supplied to the carbon dioxide gas flow path 32 by the third pump 56X. The carbon dioxide-containing gas supplied to the carbon dioxide gas flow path 32 is supplied to the electrolysis device 18 via the mixed gas flow path 34 together with the carbon dioxide gas supplied from the carbon dioxide source 14.

Thus, the oxygen gas obtained by the electrolysis of the electrolysis device 18 is used for a chemical reaction with carbon deposited on the cathode 47 of the second electrolysis device 18X. Further, the carbon dioxide gas obtained through the chemical reaction with carbon is used for electrolysis at the electrolysis device 18. Therefore, it is possible to suppress the discharge of the oxygen gas and the carbon dioxide gas into the atmosphere and to further improve the utilization efficiency of gas. In addition, the oxygen tank 50 and the carbon dioxide tank 54 can be omitted, whereby the size of the electrolysis system 10 can be reduced.

Figure 8:
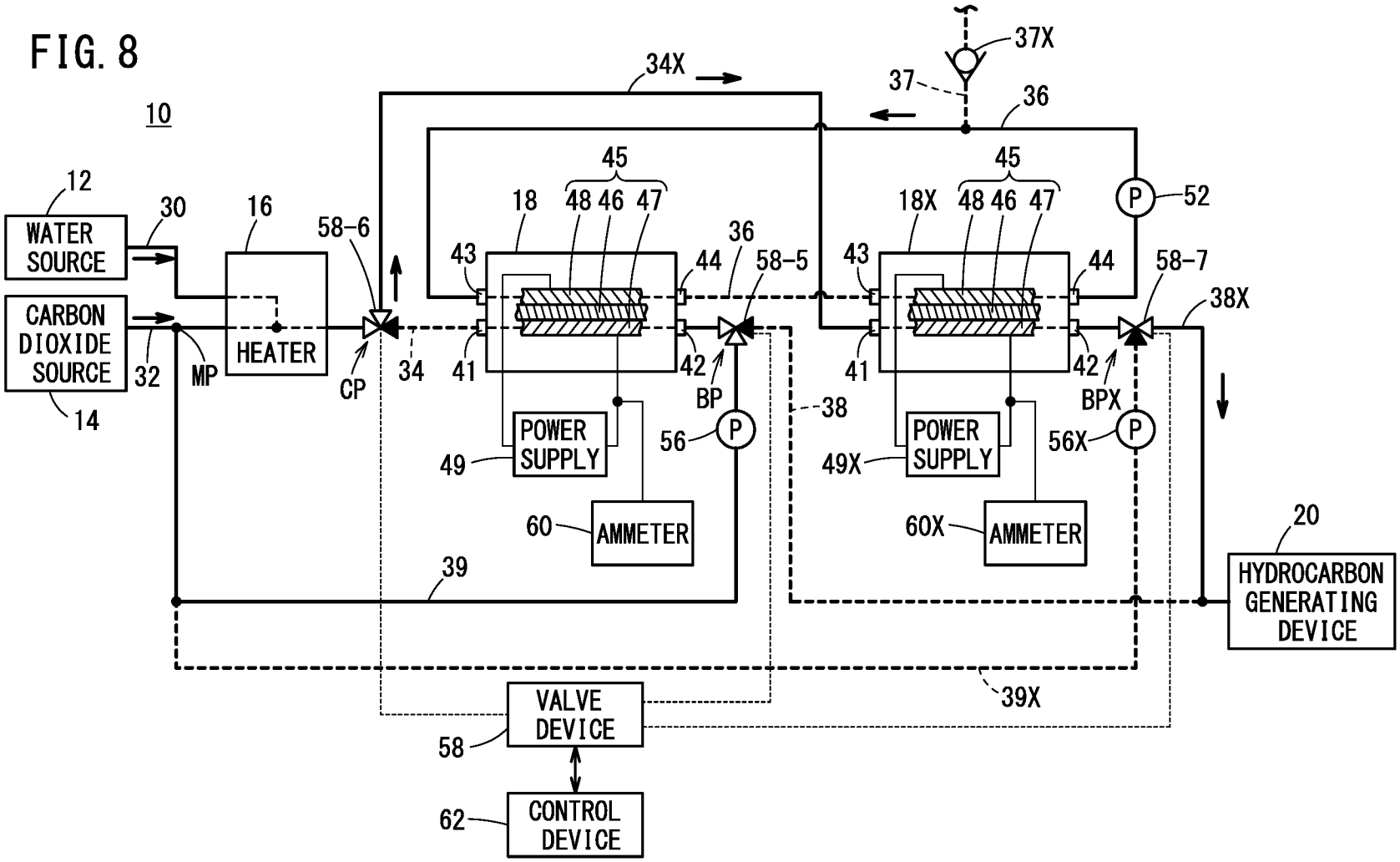
FIG. 8 is a diagram showing the flow of fluid when the consumption mode is executed for the electrolysis device and the electrolysis mode is executed for the second electrolysis device.

FIG. 8 is a diagram showing the flow of fluid when the consumption mode is executed for the electrolysis device 18 and the electrolysis mode is executed for the second electrolysis device 18X. The control device 62 controls the power supply 49, the valve device 58, the first pump 52, and the second pump 56 when the electrolysis device 18 executes the consumption mode and the second electrolysis device 18X executes the electrolysis mode.

In this case, the control device 62 turns on the first pump 52 and the second pump 56 and applies voltage to the cathode 47 and the anode 48 of the second electrolysis device 18X. The control device 62 also controls the three way valve 58-5 to close the hydrogen-containing gas flow path 38 and open the second carbon dioxide gas flow path 39. Further, the control device 62 controls the second three way valve 58-6 to close the mixed gas flow path 34 and open the second mixed gas flow path 34X. The control device 62 controls the third three way valve 58-7 to close the third carbon dioxide gas flow path 39X and open the second hydrogen-containing gas flow path 38X.

When the consumption mode is executed for the electrolysis device 18 and the electrolysis mode is executed for a second electrolysis device 18X, water vapor obtained from water output from a water source 12 and carbon dioxide gas output from a carbon dioxide source 14 flow into the second electrolysis device 18X from a cathode inlet 41 via a second mixed gas flow path 34X. The water vapor and the carbon dioxide gas flowing into the second electrolysis device 18X are electrolyzed based on the voltage applied to the cathode 47 and the anode 48.

Carbon monoxide gas and hydrogen gas generated through electrolysis at the cathode 47 are supplied as hydrogen-containing gas from the cathode outlet 42 of the second electrolysis device 18X to the hydrocarbon generating device 20 via the second hydrogen-containing gas flow path 38X.

On the other hand, the oxygen gas generated at the anode 48 through electrolysis is supplied from the anode outlet 44 of the second electrolysis device 18X to the anode inlet 43 of the electrolysis device 18 via the oxygen gas flow path 36 by the first pump 52. The oxygen gas flowing into the electrolysis device 18 from the anode inlet 43 is supplied to the anode 48, passes through the electrolyte membrane 46, and is supplied to the cathode 47.

The oxygen gas supplied to the cathode 47 of the electrolysis device 18 chemically reacts with carbon deposited on the cathode 47. The carbon dioxide gas generated through the chemical reaction flows out from the cathode outlet 42 of the electrolysis device 18 into the hydrogen-containing gas flow path 38 as carbon dioxide-containing gas containing excess oxygen gas that has not chemically reacted with carbon. The carbon dioxide containing gas flowing out into the hydrogen containing gas flow path 38 is supplied to the carbon dioxide gas flow path 32 by the second pump 56. The carbon dioxide-containing gas supplied to the carbon dioxide gas flow path 32 is supplied to the second electrolysis device 18X via the second mixed gas flow path 34X together with the carbon dioxide gas supplied from the carbon dioxide source 14.

Thus, the oxygen gas obtained through the electrolysis of the second electrolysis device 18X is used for a chemical reaction with carbon deposited on the cathode 47 of the electrolysis device 18. Further, the carbon dioxide gas obtained through the chemical reaction with carbon is used for electrolysis at the second electrolysis device 18X. Therefore, it is possible to suppress the discharge of the oxygen gas and the carbon dioxide gas into the atmosphere and to further improve the utilization efficiency of gas. In addition, the oxygen tank 50 and the carbon dioxide tank 54 can be omitted, whereby the size of the electrolysis system 10 can be reduced.

Modified Example

The electrolysis device 18 according to the first embodiment or the second embodiment may a plurality of electrolysis devices 18. In this case, the cathode inlet 41 of each electrolysis device 18 is connected in parallel with respect to the mixed gas flow path 34. Similarly, the cathode outlet 42 of each electrolysis device 18 is connected in parallel with respect to the hydrogen-containing gas flow path 38. Similarly, the anode inlet 43 and the anode outlet 44 of each electrolysis device 18 are connected in parallel with respect to the oxygen gas flow path 36.

The second electrolysis device 18X of the second embodiment may be a plurality of second electrolysis devices 18X. In this case, the cathode inlet 41 of each second electrolysis device 18X is connected in parallel with respect to the second mixed gas flow path 34X. Similarly, the cathode outlet 42 of each second electrolysis device 18X is connected in parallel with respect to the second hydrogen-containing gas flow path 38X. Similarly, the anode inlet 43 and the anode outlet 44 of each second electrolysis device 18X are connected in parallel with respect to the oxygen gas flow path 36.

Invention

The inventions and effects that can be understood from the above description will be described below.

(1) An electrolysis system (10) includes an electrolysis device (18) that includes an electrolyte membrane (46) and a pair of electrodes that are a cathode (47) sandwiching the electrolyte membrane and electrolyzes a mixed gas containing carbon dioxide gas and water vapor, a hydrocarbon generating device (20) that generates a hydrocarbon based on a hydrogen-containing gas generated through the electrolysis, a valve device (58) that switches between supply of the mixed gas to the cathode and supply of oxygen gas to the anode, an ammeter (60) that measures a current between the pair of electrodes, and a control device (62) that controls the valve device to switch what is supplied to the electrolysis device from the mixed gas to the oxygen gas when the current falls below a predetermined first threshold value while the mixed gas is supplied to the electrolysis device, and causes carbon deposited on the cathode to react chemically with the oxygen gas.

As a result, carbon deposited on the cathode can be reduced. As a result, reduction in the electrolysis efficiency for the mixed gas can be suppressed.

(2) In the electrolysis system, while the oxygen gas is supplied to the electrolysis device, when the current falls below a predetermined second threshold value, the control device may control the valve device to switch what is supplied to the electrolysis device from the oxygen gas to the mixed gas. Thus, the electrolysis can be restarted in a state in which carbon deposited on the cathode is reduced.

(3) In the electrolysis system, the control device may cause, based on the current, the electrolysis device to execute either an electrolysis mode in which the mixed gas is electrolyzed or a consumption mode in which carbon deposited on the cathode is consumed. Thus, it is possible to suppress a reduction in the electrolysis efficiency during operation of the electrolysis system.

(4) The electrolysis system may include a carbon dioxide tank (54) that stores the carbon dioxide gas generated through the chemical reaction, wherein the valve device may be configured to supply to the cathode the mixed gas containing the carbon dioxide gas and the water vapor stored in the carbon dioxide tank. As a result, the emission of carbon dioxide gas into the atmosphere can be suppressed and the utilization efficiency of carbon dioxide gas can be improved.

(5) In the electrolysis system, the valve device may supply the carbon dioxide gas contained in the mixed gas from at least one of the carbon dioxide tank or a carbon dioxide source (14) other than the carbon dioxide tank, and when the gas pressure in the carbon dioxide tank falls below a predetermined lower limit value, the control device may control the valve device to start supplying the carbon dioxide gas from the carbon dioxide source. Thus, the utilization efficiency of the carbon dioxide gas can be improved.

(6) The electrolysis system may include an oxygen tank (50) that stores the oxygen gas generated at the anode through the electrolysis, wherein the valve device may supply the oxygen gas from the oxygen tank to the cathode. As a result, the discharge of the oxygen gas into the atmosphere can be suppressed and the utilization efficiency of the oxygen gas can be improved.

(7) In the electrolysis system, the control device may cause the oxygen gas generated at the anode through the electrolysis to be stored in the oxygen tank until the gas pressure in the oxygen tank reaches a predetermined upper limit value. As a result, excessive storage of oxygen gas in the oxygen tank can be suppressed.

(8) The electrolysis system may further include a second electrolysis device (18X) that includes the electrolyte membrane and the pair of electrodes and electrolyzes the mixed gas, wherein the valve device may be configured to supply the oxygen gas to the anode of the electrolysis device by supplying the mixed gas to the cathode of the second electrolysis device. Thus, it is possible to suppress the discharge of the oxygen gas and the carbon dioxide gas into the atmosphere and to further improve the utilization efficiency of the gas. In addition, the oxygen tank and the carbon dioxide tank can be omitted, whereby the size of the electrolysis system is reduced.

The present invention is not limited to the above disclosure, and various modifications are possible without departing from the essence and gist of the present invention.

The invention claimed is:

1. An electrolysis system comprising:

an electrolysis device that
includes
an electrolyte membrane and
a pair of electrodes that are a cathode and an anode sandwiching the electrolyte membrane and
electrolyzes a mixed gas containing carbon dioxide gas and water vapor; and a hydrocarbon generating device that generates a hydrocarbon based on a hydrogen-containing gas generated through the electrolysis, the electrolysis system further comprising:

a valve device that switches between supply of the mixed gas to the cathode and supply of oxygen gas to the anode;

an ammeter that measures a current between the pair of electrodes; and a control device that controls the valve device to switch what is supplied to the electrolysis device from the mixed gas to the oxygen gas when the current falls below a predetermined first threshold value while the mixed gas is supplied to the electrolysis device, and causes carbon deposited on the cathode to react chemically with oxygen ions generated from the oxygen gas for generating a power-generation current, and when the current measured by the ammeter falls below a predetermined second threshold value while the oxygen gas is supplied to the electrolysis device, the control device controls the valve device to switch what is supplied to the electrolysis device from the oxygen gas to the mixed gas.

2. The electrolysis system according to claim 1, wherein the control device causes, based on the current measured by the ammeter, the electrolysis device to execute either an electrolysis mode in which the mixed gas is electrolyzed or a consumption mode in which carbon deposited on the cathode is consumed.

3. The electrolysis system according to claim 1, further comprising a carbon dioxide tank that stores the carbon dioxide gas generated through the chemical reaction, wherein the valve device is configured to supply to the cathode the mixed gas containing the water vapor and the carbon dioxide gas stored in the carbon dioxide tank.

4. The electrolysis system according to claim 3, wherein the valve device is configured to supply the carbon dioxide gas contained in the mixed gas from at least one of the carbon dioxide tank or a carbon dioxide source other than the carbon dioxide tank, and when a gas pressure in the carbon dioxide tank falls below a predetermined lower limit value, the control device controls the valve device to start supplying the carbon dioxide gas from the carbon dioxide source.

5. The electrolysis system according to claim 1, further comprising an oxygen tank that stores the oxygen gas generated at the anode through the electrolysis, wherein the valve device is configured to supply the oxygen gas from the oxygen tank to the cathode.

6. The electrolysis system according to claim 5, wherein the control device causes the oxygen gas generated at the anode through the electrolysis to be stored in the oxygen tank until a gas pressure in the oxygen tank reaches a predetermined upper limit value.

7. The electrolysis system according to claim 1, further comprising a second electrolysis device that includes the electrolyte membrane and the pair of electrodes and electrolyzes the mixed gas, wherein the valve device is configured to supply the oxygen gas to the anode of the electrolysis device by supplying the mixed gas to the cathode of the second electrolysis device.

* * * * *